United States Patent [19]

Shulman

[11] Patent Number: 4,531,765

[45] Date of Patent: Jul. 30, 1985

[54] COLOR CODED ID CARDS

[75] Inventor: Joseph Shulman, Hyde Park, Mass.

[73] Assignee: Polaroid Corporation, Patent Dept., Cambridge, Mass.

[21] Appl. No.: 221,201

[22] Filed: Dec. 29, 1980

[51] Int. Cl.[3] ..... B42D 15/02

[52] U.S. Cl. ..... 283;114; 156/108; 428/204; 283/904

[58] Field of Search ..... 283/7, 9 R, 107, 108, 283/109, 110, 111, 112, 114, 904; 40/2.2, 594, 615; 156/108; 428/204, 207, 916, 203

[56] References Cited

U.S. PATENT DOCUMENTS

| | | | |
|---|---|---|---|
| 2,251,486 | 8/1941 | Hanson | 428/518 |
| 3,802,944 | 4/1974 | Tung | 40/615 X |
| 3,930,924 | 1/1976 | Oka et al. | 156/268 |
| 4,151,666 | 5/1979 | Raphael et al. | 40/2.2 |
| 4,165,002 | 8/1979 | Meagher | 206/312 X |
| 4,183,554 | 1/1980 | Howard, Jr. | 40/2.2 X |
| 4,199,391 | 4/1980 | Andrews | 156/324.4 |
| 4,223,918 | 9/1980 | Smoczynski | 283/7 |

*Primary Examiner*—Paul A. Bell

*Attorney, Agent, or Firm*—Louis G. Xiarhos

[57] ABSTRACT

Laminated documents, such as ID cards, including a color-coded protective assembly comprising a novel pigment composition integrated with an adhesive bond within the assembly.

5 Claims, 2 Drawing Figures

COLOR CODED ID CARDS

Laminated documents, such as identification (ID) cards, including an information-bearing document covered with a transparent protective sheet material or sealed between the sheets of a protective pouch, are well known in the art. A favored structure for fully protecting the front and rear of the encased document is to seal it in an envelope-type pouch. This typically would be accomplished by providing a pouch having front and rear protective sheet members sealed along a portion of their peripheral edge and having an open portion adapted to receive the information-bearing document. Following insertion of the ID document, the remaining open side or sides are then sealed, preferably by heat sealing techniques. A particularly favored structure includes a frame member set between the protective sheets and outlining a well section of dimensions suitable to accept and contain the inserted ID document.

In order to ensure the integrity of an encased information-bearing document, a commonly sought feature of ID structures is to achieve a card providing a security seal between the surface of the information bearing document and the inner surface of the overlying protective sheet. A security seal is characterized by the creation of evident damage to the encased document upon an attempt to disassemble the ID card for unauthorized alteration or other such purposes. If a security seal exists, all or at least portions of the image-containing layer of the document will be removed with the protective sheet material thereby evidencing the intrusion or attempted intrusion into the card.

To supplement the identifying or personalized information embodied within a laminated document, it also is a desirable feature to include some means of immediate bearer status recognition. For example, it is advantageous to be able to readily distinguish the classification of individuals within a card-bearing group (e.g., class or college membership within a university), security clearance status of privileged individuals for access to restricted areas, and the like. A convenient device for accomplishing this ready status recognition is the color-coding of ID cards being issued to designated groups. For example, each of several designated groups are issued cards prominently displaying a different, easily distinguishable color.

Now, according to the present invention, color-coded identification cards are provided through the use of a pigment composition integrated with an adhesive bond within an ID card structure.

Polyester materials, in particular polymerized polyethylene glycol esters (e.g., polyethylene terephthalate), have been found to be favored plastic sheet materials for use in ID card structures. This favored utility is due to the strength, flexibility and anti-abrasive nature of the polyesters. These polyester materials commonly are bonded together using any of the class of adhesives known in the art as low molecular weight polyester adhesives. In bonding polyethylene glycol esters, these adhesives typically include heat-activated copolymeric compositions such as ethylene/vinyl acetate (EVA), ethylene/ethyl acrylate (EEA), ethylene/acrylic acid (EAA), and the like. Ethylene/ethyl acrylate and ethylene/vinyl acetate are particularly preferred adhesive materials.

As might be anticipated, the incorporation of a particulate material such as a pigment additive within the adhesive composition used to bond together the components of the ID card structure tends to seriously impair the resulting bond achieved, and, hence, compromises the security of the encased document. To diminish the security of an ID card, exposing it to increased risk of unauthorized alteration, generally would not be an acceptable trade-off to the advantages of color-coded recognition features.

Pursuant to the present invention, however, pigment material is integrated with an adhesive bond between polyester ID card components in such a manner that easily recognizable coloration is provided while accomplishing the unexpected benefit of enhanced security adhesion. The pigments are dispersed in a select binder medium and applied as a supplemental layer between standard polyester adhesive layers. The binder medium is a polyvinylidene chloride latex. Suitable latices are commercially available under the trademarks "AMSCO" M3-153 from Union Chemical Company and "DARAN" 805 from W. R. Grace Company, and under the designation "EXPERIMENTAL LATEX-XD-30952.22" from Dow Chemical Company.

The particular pigment employed is not critical. Suitable pigments, providing a favorable range of coloration, include "MONASTRAL® BLUE BW-372-P," "MONASTRAL® GREEN GW-749-P," "DALAMAR® YELLOW YW-718-P" and "TOLUIDINE RED RW-704-P" available as aqueous dispersions from E. I. Du Pont de Nemours Company. The concentration of pigment that may be used varies with the particular pigment selected and the intensity of coloration desired. Suitable pigment dispersions in polyvinylidene chloride latex have been prepared with concentrations of pigment ranging from about 2 to about 20 parts by weight of pigment to about 100 parts by weight of latex.

The pigment composition can be integrated with the bond between any suitable polyester components in an ID card structure; the selected location and arrangement being determined by the particular ID card structure and the desired coloration effect. A convenient arrangement found to provide an effective color-coding display is to apply a layer of the pigment composition to a substantial portion of the frontal peripheral adhesive surface of the rear protective sheet member of an ID card pouch or, in a preferred ID card arrangement, the entire frontal adhesive surface of the document-receiving frame member of an ID card structure. After a document is inserted into the preferred structure and the transparent sheet is sealed in position, an ID card is achieved featuring a centrally positioned identification document surrounded by an easily recognizable colored border.

The invention may be further understood by reference to the FIGS. in which

Figure 1:
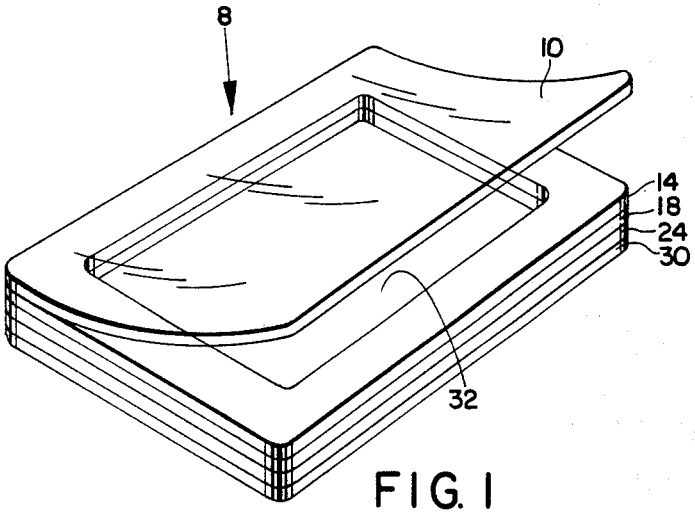
FIG. 1 is a perspective view of an ID card protective assembly.

A preferred embodiment of the invention is illustrated in FIG. 1. Envelope-type protective pouch structure 8 typically comprises a colorless, transparent polyester cover sheet 10, a colorless, transparent polyester back sheet 30, an opaque polyester sheet 24, and an opaque polyester frame member 18. Frame member 18 defines a well or recess 32, into which an information-bearing ID document can be inserted. Cover sheet 10 is prewelded along one of its peripheral edges to maintain component alignment and integrity prior to complete sealing; cover 10 can conveniently be lifted back to permit opening the pouch in such a manner as is shown in FIG. 1. In this opened position, the pouch is set to readily accommodate insertion of an information-bearing ID document, commonly a photographic print. This photo may be prepared by any of the known photographic techniques and the method of preparation per se comprises no part of this invention. Since it is, of course, preferable that the photo system employed be such that the subject or bearer can be photographed and the card prepared and issued on the spot, the preferred system for preparing the photo utilizes principles in photography known as diffusion transfer to obtain either black-and-white or color photos, as the case may be. Most preferred are color images and these may be obtained, for example, in accordance with the procedures described in U.S. Pat. No. 2,983,606.

A particularly useful system for preparing the photo utilizes diffusion transfer photographic principles such as the color system described in the aforementioned U.S. patent to provide a photo of the bearer along with descriptive information in the camera so that both the subject matter and the descriptive matter pertaining to the bearer are simultaneously photographed to provide a single developable image which is thereafter processed to provide a transfer print comprising a suitable support having thereon an image-bearing layer containing an image of the subject at one portion thereof and the descriptive matter at another portion thereof.

The procedure for preparing the photographic print may be accomplished most expeditiously using a POLAROID ID-3 Land Identification System equipped with a diffusion transfer color film unit available from Polaroid Corporation under the trademark designation POLACOLOR 2.

The pouch components 18, 24 and 30 are prebonded together through layers of a suitable polyester adhesive (not shown); the internal facing surfaces of cover sheet 10 and frame member 18 also include layers of a suitable heat activatable polyester adhesive, e.g. ethylene/ethyl acrylate (not shown), which accomplishes a secure bond between these members upon heat sealing the structure. Pursuant to the invention, a layer of pigment composition 14, comprising a dispersion of suitable pigment material in a polyvinylidene chloride latex binder, is applied on top of the adhesive layer of frame member 18, between the frame member 18 and cover sheet 10. Accordingly, in the embodiment shown, pigment layer 14 defines a colored border around the peripheral edge of an ID document (not shown) encased within recess 32 beneath the colorless protective cover sheet 10. Upon heat sealing the ID card assembly, a secure bond is achieved between polyester members 10 and 18 through the polyester adhesive layers and the pigment composition 14.

Figure 2:
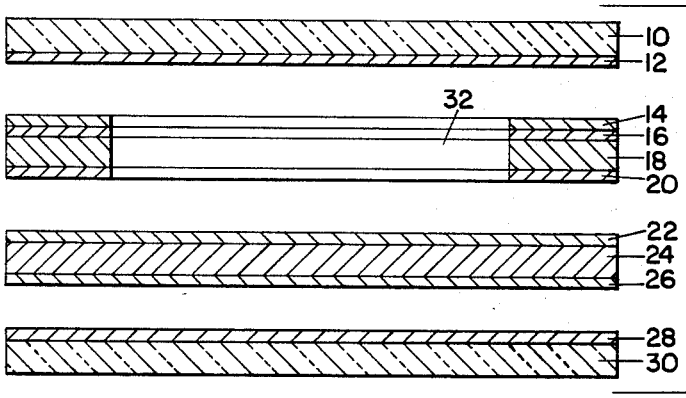
FIG. 2 is a magnified, side, sectional, exploded view of the component layers of an ID envelope assembly.

The exploded side view of FIG. 2 depicts each of the components of a preferred ID envelope structure, including the individual adhesive layers and the colored pigment composition layer of the present invention. The protective cover sheet 10 comprises a colorless, transparent polyester material supporting a layer of a polyester adhesive 12, typically ethylene/ethyl acrylate. Sheet 24 comprises an opaque, polyester material supporting layers of polyester adhesive 22 and 26 on each of its sides. Back sheet 30 comprises a colorless, transparent polyester material including an adhesive layer 28 to provide a bond to sheet 24. Sandwiched between cover sheet 10 and sheet 24 is frame member 18 including well opening 32 which is designed to accommodate an inserted ID document. Both sides of the frame member support polyester adhesive layers 16 and 20. As frame member 18 commonly comprises an opaque polyester material, colored pigment composition layer 14 is shown applied on top of adhesive layer 16, in order to provide frontal observation of color display.

The following example is provided to further illustrate the invention:

EXAMPLE

Colored pigment dispersions were prepared by slowly adding pigment material to a stirred polyvinylidene chloride latex composition (obtained commercially from Union Chemical Company under the trademark AMSCO M3-153). Four pigment dispersions were formulated to provide a variety of coloration: MONASTRAL BLUE BW-372P (100 parts by weight (PBW) latex/6 PBW pigment); MONASTRAL GREEN GW-749P (100 PBW latex/20 PBW pigment); DALAMAR YELLOW YW-718P (100 PBW latex/2PBW pigment); and TOLUIDINE RED RW-704P (100 PBW latex6/PBW pigment). The pigment materials were obtained commercially from E. I. Du Pont de Nemours Company.

Each pigment dispersion was applied to an adhesive-coated opaque polyester sheet (4 mil polyester coated with 6 mil EEA adhesive) using a 2 mil coating bar. The coatings were then dried in a circulating air oven at 90° C. for 4 minutes.

The colored polyester sheets were then used in fabricating ID card protective pouch structures. As a comparative example, an ID pouch also was prepared using an uncolored EEA coated polyester sheet. The sheets were cut to form a frame member having a centrally positioned well opening; each frame member was bonded on one side to a sheet of opaque polyester material backed by a sheet of clear colorless polyester and, on the other side was welded along one of its peripheral edges to a cover sheet of clear, colorless polyester material. Photographic identification documents were prepared using a POLAROID ID-3 Land Identification System. The ID documents then were inserted into the well openings of the protective pouches and the structures were laminated together using heated rollers at about 200°-210° F.

The resultant cards featured densely colored borders having uniform intensity. A durable security seal was achieved between the cover sheet and the frame member supporting the pigment dispersion. The seal accomplished exhibited an enhanced durability over that of the comparably prepared ID card assembly prepared using an uncolored EEA coated polyester sheet to which a pigment dispersion had not been applied.

Certain modifications may be made in details of the above description of the invention without departing from the spirit and scope of the invention defined in the appended claims. For example, it is obvious from FIG. 2 that if frame member 18 were a colorless, transparent polyester material, the pigment composition readily could be applied on either adhesive surfaces 22 or 26 of sheet 24 and still be effectively observed through the front of the card. If frontal coloration is not required, the pigment readily could be suitably located to provide rear coloration; or both frontal and rear coloration could be arranged. Accordingly, it is intended that all matter contained in the above description or shown in the accompanying drawings be interpreted as illustrative and not limiting in nature.

What is claimed is:

1. An ID card structure comprising an information-bearing document encased within an envelope having front and back sheets of polyester material sandwiching a polyester frame member having a well opening suitable to accommodate said information-bearing document, and including a color coding arrangement comprising: a pigment dispersion in a poly-vinylidene chloride latex, said color coding arrangement being disposed between two layers of adhesive respectively supported on facing surfaces of the front sheet and the frame member and providing an adhesive bond therebetween and being disposed in such a manner so as to present a color-coded border display about the peripheral edge of said ID card structure.

2. The ID card structure of claim 1 wherein said adhesive bond is provided by an adhesive selected from the group consisting of ethylene/vinyl acetate and ethylene/ethyl acrylate copolymers.

3. The ID card structure of claim 2 wherein said adhesive is an ethylene/vinyl acetate copolymer.

4. The ID card structure of claim 1 wherein said pigment dispersion is disposed so as to present a densely colored border about the periphery of the encased document.

5. The ID card structure of claim 4 wherein said pigment dispersion comprises about 2 to about 20 parts by weight of pigment to about 100 parts by weight of polyvinylidene chloride latex.

* * * * *